US009151146B2

(12) United States Patent
Rey-Bethbeder et al.

(10) Patent No.: US 9,151,146 B2
(45) Date of Patent: Oct. 6, 2015

(54) METHOD FOR EXTRACTING HYDROCARBONS BY IN-SITU ELECTROMAGNETIC HEATING OF AN UNDERGROUND FORMATION

(75) Inventors: Franck Rey-Bethbeder, Lacq (FR); Jacques Lavaud, Pau (FR); Philippe Espagne, Bernadets (FR)

(73) Assignee: TOTAL S.A., Courbevoie (FR)

( * ) Notice: Subject to any disclaimer, the term of this patent is extended or adjusted under 35 U.S.C. 154(b) by 855 days.

(21) Appl. No.: 13/381,425

(22) PCT Filed: Jul. 2, 2010

(86) PCT No.: PCT/IB2010/053036

§ 371 (c)(1), (2), (4) Date: Dec. 29, 2011

(87) PCT Pub. No.: WO2011/001408

PCT Pub. Date: Jan. 6, 2011

(65) Prior Publication Data

US 2012/0118879 A1 May 17, 2012

(30) Foreign Application Priority Data

Jul. 3, 2009 (FR) ..... 09 03279

(51) Int. Cl.

| | |
|---|---|
| ***E21B 36/04*** | (2006.01) |
| ***E21B 43/24*** | (2006.01) |
| ***E21B 43/30*** | (2006.01) |
| ***H05B 6/08*** | (2006.01) |

(52) U.S. Cl.

CPC ..... *E21B 43/2401* (2013.01); *E21B 36/04* (2013.01); *E21B 43/305* (2013.01); *H05B 6/08* (2013.01); *H05B 2214/03* (2013.01)

(58) Field of Classification Search

USPC ..... 166/248, 60, 57, 302

See application file for complete search history.

(56) References Cited

U.S. PATENT DOCUMENTS

| | | | | |
|---|---|---|---|---|
| 4,390,067 | A | 6/1983 | Willman | |
| 4,410,216 | A | 10/1983 | Allen | |
| 4,449,585 | A * | 5/1984 | Bridges et al. | 166/248 |
| 4,571,473 | A | 2/1986 | Wyslouzil et al. | |
| 4,620,593 | A | 11/1986 | Haagensen | |
| 4,700,716 | A | 10/1987 | Kasevich et al. | |
| 4,930,067 | A | 5/1990 | Nakamura | |
| 5,065,819 | A | 11/1991 | Kasevich | |

(Continued)

FOREIGN PATENT DOCUMENTS

| | | |
|---|---|---|
| GB | 896407 | 5/1962 |
| WO | WO 2007/147053 | 12/2007 |

(Continued)

*Primary Examiner* — Giovanna C Wright

(74) *Attorney, Agent, or Firm* — Harness, Dickey & Pierce, P.L.C.

(57) ABSTRACT

The disclosure relates to a plant for extracting hydrocarbons contained in an underground formation including:

hydrocarbon tapping;

at least one generator;

at least one electromagnetic heating well in the underground formation, including an electromagnetic heating device connected to the generator;

wherein the electromagnetic heating device includes a radiating coaxial line. The disclosure also relates to a method for extracting hydrocarbons from an underground formation able to be implemented using the plant.

15 Claims, 2 Drawing Sheets

(56) References Cited

U.S. PATENT DOCUMENTS

| | | | | |
|---|---|---|---|---|
| 6,009,940 | A * | 1/2000 | Eck et al. | 166/60 |
| 6,189,611 | B1 | 2/2001 | Kasevich | |
| 6,426,685 | B2 | 7/2002 | Mahlandt et al. | |
| 6,631,761 | B2 | 10/2003 | Yuan et al. | |
| 7,441,597 | B2 * | 10/2008 | Kasevich | 166/247 |
| 7,831,133 | B2 | 11/2010 | Vinegar et al. | |
| 2009/0050318 | A1 | 2/2009 | Kasevich | |
| 2010/0200223 | A1 | 8/2010 | Mauduit et al. | |

FOREIGN PATENT DOCUMENTS

| | | |
|---|---|---|
| WO | WO 2008/098850 | 8/2008 |
| WO | WO 2009/027262 | 3/2009 |
| WO | WO 2009/027273 | 3/2009 |
| WO | WO 2009/027305 | 3/2009 |
| WO | WO 2010/023519 | 3/2010 |

* cited by examiner

METHOD FOR EXTRACTING HYDROCARBONS BY IN-SITU ELECTROMAGNETIC HEATING OF AN UNDERGROUND FORMATION

CROSS-REFERENCE TO RELATED APPLICATIONS

This application is a National Phase Entry of International Application No. PCT/IB2010/053036, filed on Jul. 2, 2010, which claims priority to French Patent Application Serial No. 0903279, filed on Jul. 3, 2009, both of which are incorporated by reference herein.

FIELD OF THE INVENTION

The present invention relates to a method for extracting hydrocarbons by in-situ electromagnetic heating of an underground formation, as well as a plant adapted to implement said method.

BACKGROUND

The substantial viscosity of the hydrocarbons present in certain deposits (heavy oils) poses considerable extraction problems. In such cases, it is generally necessary to decrease the viscosity of (fluidify) heavy oils so as to make them more mobile and therefore be able to extract them. This is particularly important for the exploitation of bituminous sands or shales. Many techniques have already been proposed to that end, in particular "SAGD" (steam-assisted gravity drainage), which consists of injecting steam into the deposit, heating it by heat conduction (for example using electric resistances) or in-situ combustion, which consists of injecting an oxidizing agent, generally air, through injection wells and initiating a combustion within the deposit, so as to develop combustion fronts from air injection wells and towards the production wells.

Another technique that has been proposed consists of proceeding with in situ electromagnetic heating of the reservoir. A first category of in situ electromagnetic heating of the reservoir is that of heating by electromagnetic radiation (i.e. radiofrequency or microwave) using an antenna arranged in the reservoir. Document WO 2007/147053 describes an example of such a system: a radiofrequency generator is placed on the surface; the energy produced is irradiated via a radiofrequency antenna positioned in a specific horizontal or vertical well. The production well, part of which is horizontal, is situated under the radiofrequency antenna.

A second category of in situ electromagnetic heating of the reservoir is that of induction heating. For example, document WO 2008/098850 describes, in one particular embodiment, an injection well geometry passing through the reservoir and imposing a circulation of electric current caused in the reservoir. The injection well also has a steam injection function. A high-frequency generator provides the electrical power necessary for the induction. The two terminals of the generator are connected to the two ends of the injection well, which thus heats the reservoir by induction. The injection well therefore goes up to the surface, the two ends of the injection well then necessarily being connected to the generator. The well then has a particular geometry, of the U-well type. In other cases, the electric circuit is formed by the injection well on one hand (connected to a terminal of the generator), and an electrode installed in a pocket of saltwater on the other hand (connected to the other terminal of the generator). In still another case, the heating for the reservoir is of the resistive type, an electric circuit being established between two remote wells, situated on either side of a deposit to be heated.

The drilling geometry necessary to implement induction heating for these two types of architecture would be extremely complex to produce. Moreover, in these two architectures, the injection tube heats the reservoir by induction over the entire length thereof, therefore including in its vertical portion. Substantial energy losses occur at the edges of the conductors, in the overburden.

Document WO 2009/027273 describes a method for injecting water in the reservoir, the water being vaporized by electric heating in the reservoir. For example, the water injection well and the production well can serve as electrodes. Document WO 2009/027262 describes the use of at least one additional pipe electrically connected to the injection well in order to inductively heat the zone situated between the additional pipe and the injection well.

Document WO 2009/027305 describes a plant for heating a hydrocarbon reservoir comprising an outside alternator providing the electrical power serving to power a driving circuit. The magnetic field causes currents in the reservoir, and brings about the heating thereof. One particular conductor, of the Litz cable type, is used in order to proceed with in situ inductive heating. This Litz cable comprises several conductors aligned to facilitate the passage of the current. The strong impedance thus generated at a high frequency is offset by the introduction of serial capacitances, in order to avoid overvoltages. The cable forms a loop in the reservoir, its two ends being connected to a surface generator. This system has the drawback of only working for a single determined electrical frequency, which poses a problem since the frequency must ideally adapt to the nature of the reservoir and the evolution thereof. In other words, this system is not very efficient at the beginning and end of production and involves slow preheating and very good knowledge of the reservoir from the outset.

Moreover, in the main embodiment, the conductors are placed at the same depth in the reservoir, next to each other, at a given distance. Thus, the magnetic radiation given off by one conductor is cancelled by the other conductor. Although such a geometry makes it possible to avoid energy losses in the overburden, it does however require that the conductors be spaced away from each other at the reservoir, to allow the emission of electromagnetic energy and to ensure in fine the heating of the reservoir. This drilling geometry is extremely complex to implement. All of the systems described above have the drawback of being oftentimes heavy and complex to implement. Moreover, these systems are only suited to a very particular type of electromagnetic heating, whether by radiation (at the highest frequencies) or induction (at the lowest frequencies), or are even only suited to a very specific frequency.

There is therefore a need for a system for the electromagnetic heating of an underground formation that is easier to implement and more flexible. In particular, there is a need for a system for electromagnetic heating of an underground formation that can operate by radiation as well as by induction of capacitive currents, in a wide range of frequencies, that can adapt easily to all types of underground formation.

SUMMARY

The invention first relates to a plant for extracting hydrocarbons contained in an underground formation, comprising:

- hydrocarbon tapping means;
- at least one generator;
- at least one electromagnetic heating well in the underground formation, comprising an electromagnetic heating device connected to the generator;

wherein the electromagnetic heating device comprises a radiating coaxial line.

According to one embodiment, the aforementioned plant comprises at least one production well, preferably a plurality of production wells, in the underground formation, said production wells comprising at least part of the hydrocarbon tapping means. According to one embodiment,

- the electromagnetic heating well comprises an essentially vertical portion and an essentially horizontal portion;
- the production well comprises an essentially vertical portion and an essentially horizontal portion;
- the essentially horizontal portion of the electromagnetic heating well being arranged above the essentially horizontal portion of the production well; and
- the essentially horizontal portion of the electromagnetic heating well forming, with the essentially horizontal portion of the production well, in the horizontal plane, an angle between 60 and 120°, preferably between 70 and 110°, more particularly preferably between 80 and 100°, said angle ideally being different from 90°.

According to one embodiment, the electromagnetic heating device comprises a coaxial transmission line. According to one embodiment, the electromagnetic heating well comprises an essentially vertical portion and an essentially horizontal portion, at least part of the coaxial transmission line being arranged in the essentially vertical portion, and at least part, preferably all, of the radiating coaxial line being arranged in the essentially horizontal portion. According to one embodiment, the electromagnetic heating device comprises an outer conductor, an inner conductor, and insulating elements sliding between the outer conductor and the inner conductor.

According to one embodiment, the electromagnetic heating well also comprises at least part of the hydrocarbon tapping means. According to one embodiment, the electromagnetic heating well comprises means for injecting water or steam into the underground formation. According to one embodiment, the electromagnetic heating well has one end in the underground formation, the electromagnetic heating device preferably being short-circuited or re-entrant at said end.

According to one embodiment, the generator comprises a high-frequency generator arranged in the electromagnetic heating well. According to one embodiment, the electromagnetic heating device is able to move in the electromagnetic heating well. According to one embodiment, the radiating coaxial line comprises an inner conductor and an outer conductor interrupted by a plurality of insulating windows.

The invention also relates to a method for extracting hydrocarbons in an underground formation, comprising:

- the electromagnetic heating of the underground formation using at least one electromagnetic heating device positioned in the underground formation, and comprising a radiating coaxial line; and
- tapping the hydrocarbons in the underground formation and transporting the hydrocarbons towards the surface.

According to one embodiment, the electromagnetic heating of the underground formation is done by induction and/or by radiation. According to one embodiment, the aforementioned method also comprises:

- heating the underground formation by injecting steam into the underground formation; or
- producing steam in the underground formation by injecting water and electromagnetically heating the water, and heating the underground formation via the steam produced.

According to one embodiment, the aforementioned method is carried out in a plant as described above.

The present invention makes it possible to overcome the drawbacks of the state of the art. It more particularly provides a method and a plant for electromagnetic heating of an underground formation that are easier to implement and more flexible. In particular, the method and the plant according to the invention can be implemented in a wide range of frequencies, whether in the induction or radiation field. Thus, the invention makes it possible to adapt easily to any type of underground formation. This is accomplished owing to the use of an in situ electromagnetic heating device comprising a radiating coaxial line.

According to certain specific embodiments, the present invention also has one or more of the advantageous features listed below.

- It is possible to provide that the electromagnetic heating wells also perform a hydrocarbon production function. This makes it possible to optimize the output and also to regulate the bottom hole pressure at an acceptable value, in particular at the beginning of heating of the underground formation, the irreducible water of the underground formation vaporizing, which can lead to a pressure increase before the beginning of production by the production wells.
- When the underground formation is heated only by electromagnetic heating, one avoids the high water consumption that is required by SAGD-type methods. Furthermore, the amount of water produced in a mixture with the hydrocarbons is reduced, which makes it possible to decrease surface treatment and to produce better quality hydrocarbons.
- Alternatively, it is possible to proceed with steam heating as a supplement to the electromagnetic heating, using the same heating wells. Thus it is possible to optimize heating of the underground formation.
- The penetration of the electromagnetic energy inside the reservoir by induction and natural self-regulation by vaporization of the irreducible water make it possible not to have to go up to a very high temperature and then wait for the heat to spread by thermal conduction or convection, in order to reach a high temperature in the areas remote from the heating site.
- The invention makes it possible to use a traditional drilling geometry, with wells comprising an essentially vertical part of the surface towards the bottom, and an essentially horizontal part in the bottom. Thus, the industrial feasibility of the invention is much greater than that of systems requiring U-drilling, as described in document WO 2008/098850, for example.
- When the essentially horizontal parts of the electromagnetic heating well(s) form an angle close to 90° with the essentially horizontal parts of the production well(s), heating of the production wells is limited. This can make it possible to use conventional production wells, equipped with a metal casing. More particularly, it can be advantageous to use an angle slightly different from 90°, in order to, however, generate a certain additional (optimized) heating close to the production wells. In this way one further improves the flow close to the production wells and it is in particular possible to limit paraffin wax deposits around the production wells. This additional heating can also enable in situ upgrading.

DETAILED DESCRIPTION

The invention is now described in more detail and non-limiting way in the following description.

Plant

Figure 1:
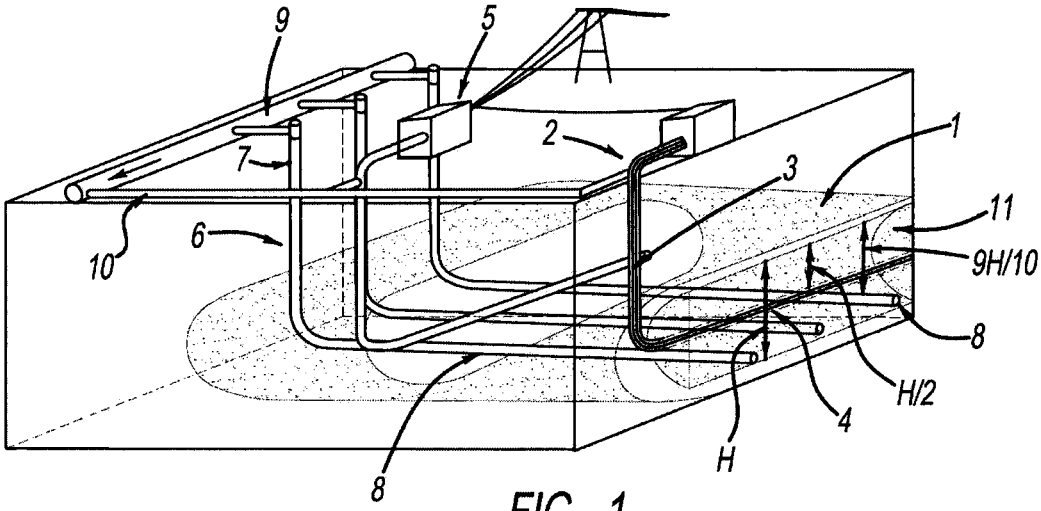
FIG. 1 diagrammatically illustrates one embodiment of the hydrocarbon extraction plant according to the invention.

In reference to FIG. 1, a hydrocarbon extraction plant according to the invention comprises hydrocarbon tapping means positioned in an underground formation 1, at least one generator 5, and at least one electromagnetic heating well 2 in the underground formation 1. In general, the hydrocarbon tapping means are comprised (in whole or in part) in one or several production wells 6 in the underground formation 1.

Generally, the underground formation 1 comprises hydrocarbons or comprises a material (organic materials) capable of being converted into hydrocarbons by physical or chemical transformation. The formation 1 can for example be sandy, argillaceous, or carbonated. It can involve a reservoir comprising any type of gaseous or liquid hydrocarbons, including natural gas, bitumen, heavy oils, mobile oils, and conventional oils. The formation 1 can also comprise bituminous shales, bituminous sands, methane hydrates or gas adsorbed on clay. It can also involve a coal deposit.

Preferably, the plant comprises a plurality of production wells 6 that can for example be aligned. Preferably, the plant comprises a plurality of electromagnetic heating wells 2, which can for example be aligned. The production wells 6 are intended to extract the hydrocarbons contained in the underground formation 1 (possibly mixed with water, solid matter and other contaminants), while the electromagnetic heating wells 2 are primarily intended to perform in situ heating of the underground formation 1 in order to mobilize the hydrocarbons.

When several production wells 6 are present, a collection pipe 9 is provided that is adapted to recover the hydrocarbons extracted from the various production wells 6. It is possible to provide that the electromagnetic heating wells 2 comprise part of the hydrocarbon tapping means, i.e. also perform a hydrocarbon production (extraction) function. In that case, an additional collection pipe 10 is provided adapted to recover the hydrocarbons extracted from the various electromagnetic heating wells 2. Preferably, this additional heating pipe 10 emerges in the main collection pipe 9.

It is also possible to provide that only the electromagnetic heating wells 2 perform the hydrocarbon production function, i.e. form the aforementioned hydrocarbon tapping means. In that case, no production well 6 is present. However, it is preferred for the plant to comprise both electromagnetic heating wells 2 and production wells 6 in order to allow better exploitation of the underground formation Each electromagnetic heating well 2 comprises an electromagnetic heating device that will be described in more detail below. The electromagnetic heating device is powered by a generator 5. According to the embodiment shown in FIG. 1, each electromagnetic heating device (in each electromagnetic heating well 2) is provided with a unique generator 5. It is, however, also possible to provide a single generator to power several electromagnetic heating devices (in several electromagnetic heating wells 2). Moreover, each generator 5 can be positioned on the surface, as illustrated in FIG. 1, but it can also be positioned at least partly underground, in the electromagnetic heating well 2, as will be outlined below.

Each electromagnetic heating well 2 and each production well 6 can be vertical, essentially vertical, inclined, or comprise portions with different inclines. In particular, each well can comprise a horizontal or essentially horizontal portion.

According to one preferred embodiment, each electromagnetic heating well 2 comprises an essentially vertical portion 3 and an essentially horizontal portion 4. Still according to a preferred embodiment, each production well 6 comprises an essentially vertical portion 7 and an essentially horizontal portion 8. Preferably, the essentially vertical portion of each well is the one that connects the surface to an area of interest of the underground formation 1; and the essentially horizontal portion of each well is situated deep down, and advantageously passes through one or several areas of the underground formation 1 rich in hydrocarbons.

In the context of this application, "essentially horizontal" means "forming an angle smaller than or equal to 20°, preferably smaller than or equal to 10°, still more preferably smaller than or equal to 5°, relative to a horizontal plane." In the context of this application, "essentially vertical" means "forming an angle smaller than or equal to 20°, preferably smaller than or equal to 10°, still more preferably smaller than or equal to 5°, relative to the vertical direction." The presence of essentially horizontal portions in the wells makes it possible to optimize the exploitation of the underground formation.

According to one preferred embodiment, the essentially horizontal portions 4 of the electromagnetic heating wells 2 are arranged above the essentially horizontal portions 8 of the production wells 6. This configuration makes it possible to optimize the recovery of the hydrocarbons. Indeed, when the plant is in operation, each electromagnetic heating well 2 produces a heating area 11 in the underground formation 1, surrounding the electromagnetic heating well 2. According to one preferred embodiment, only the essentially horizontal portion 4 of the electromagnetic heating well 2 contributes to heating the underground formation 1, and the heating area 11 therefore then surrounds the essentially horizontal portion 4 of each electromagnetic heating well 2. In the heating area 11, the mobilized hydrocarbons tend to sink under the effect of gravity and are therefore easily recovered by the essentially horizontal portions 8 of the production wells, situated at a lower position.

As an example, one particularly optimal configuration is that shown in FIG. 1, in which the heating area 11 has a height H/2 on either side of the essentially horizontal portion 4 of each electromagnetic heating well 2 (which is equivalent to a total height H of the heating area 11), and the essentially horizontal portion 8 of each production well 6 is situated at a distance H/10 from the lower boundary of the heating area 11, and therefore at a distance 9H/10 from the upper boundary of the heating area 11. The essentially horizontal portions 4 of the electromagnetic heating wells 2 can be essentially aligned with the essentially horizontal portions 8 of the production wells 6. However, according to the preferred embodiment that is shown in FIG. 1, the former form with the latter, in the horizontal plane, a non-zero angle and in particular an angle between 60 and 120°, preferably between 70 and 110°, still more particularly preferably between 80 and 100° and in particular close to 90°. Thus, the heating of the production wells 6 is limited. This can make it possible to use conventional production wells 6, equipped with a metal casing.

According to one particular embodiment, an angle is chosen that is slightly different from 90°, so as to, however, generate a certain additional (optimized) heating close to the production wells 6. The flow is thus improved close to the production wells 6 and it is in particular possible to limit paraffin wax deposits around the production wells 6. This additional heating can also allow in situ upgrading. Preferably, each electromagnetic heating well 2 and/or each production well 6 has one end in the underground formation 1 (the other end being on the surface). In other words, it is preferable for both ends of the wells not to emerge on the surface: this considerably simplifies the drilling operations and makes it possible to minimize electrical losses in the overburden.

Electromagnetic Heating Device

Figure 2:
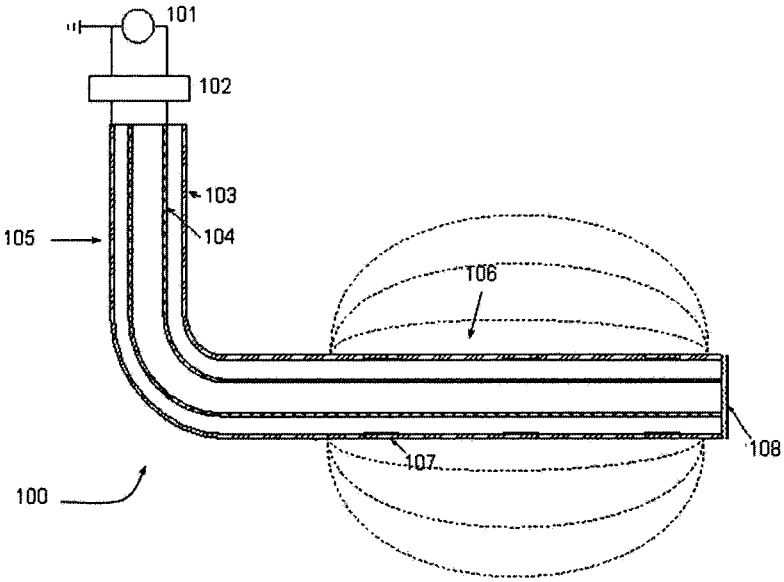
FIGS. 2 and 3 diagrammatically illustrate embodiments of electromagnetic heating devices used in the plant according to the invention.
Figure 3:
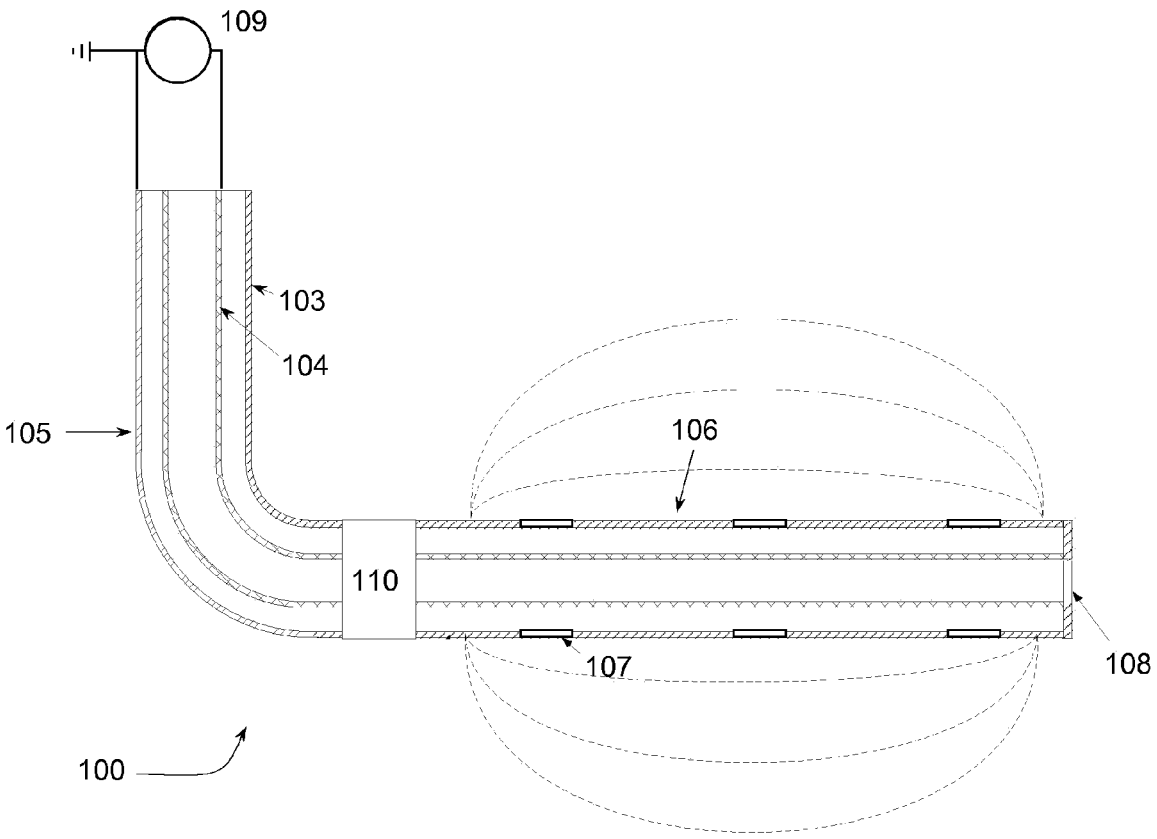

In reference to FIGS. 2 and 3, part of the electromagnetic heating device 100 positioned in an electromagnetic heating well 2 is formed by a radiating coaxial line 106. "Radiating coaxial line," also known as "coaxial leakage line," refers to a line for transporting the electric current comprising at least two coaxial conductors and capable of supplying electromagnetic energy to the environment by radiation or by induction. A radiating coaxial line is for example described in application U.S. Patent Publication No. 2001/054945.

Preferably, part of the electromagnetic heating device 100 is formed by a coaxial transmission line 105. "Coaxial transmission line" refers to a line for transporting electric current comprising at least two coaxial conductors and minimizing the losses of electromagnetic energy in the environment. The radiating coaxial line 106 and the coaxial transmission line 105 preferably comprise an outer conductor 103 and an inner conductor 104, separated by an insulating area. The outer conductor 103 (inner conductor 104, respectively) of the radiating coaxial line 106 can therefore be continuous with that of the coaxial transmission line 105, i.e. form a same conductive element with it.

The difference between the radiating coaxial line 106 and the coaxial transmission line 105 comes from the presence of insulating windows 107 on the radiating coaxial line 106. Thus, the outer conductor 103 of the radiating coaxial line 106 is interrupted by insulating windows 107. At these insulating windows 107, the electromagnetic field is capable of radiating outside the coaxial cable, which allows in fine heating of the reservoir.

These insulating windows 107 are preferably made from a material ensuring minimal dielectric losses, for example aluminum or cement. Their sizes and spacing are determined to allow the electromagnetic emission, in the form of induction, of radiation or capacitive current, over a wide given spectrum of frequencies. On the other hand, in the coaxial transmission line 105, the outer conductor 103 is not interrupted. There is no emission of energy from the coaxial cable towards the overburden. Thus, owing to this easy-to-implement device, leaks of electromagnetic energy into the environment are minimized in the coaxial transmission line 105 and are maximized or optimized in the radiating coaxial line 106.

According to one embodiment, the electromagnetic heating device 100 comprises the coaxial transmission line 105 in the essentially vertical portion 3 of the electromagnetic heating well 2, and the radiating coaxial line 106 in the essentially horizontal portion 4 of the electromagnetic heating well 2. This configuration is particularly useful for efficiently using the electromagnetic energy to heat areas of the underground formation 1 that are rich in hydrocarbons (passed through by the essentially horizontal portions 4 of the electromagnetic heating wells 2) while minimizing energy losses for passing through ground lacking hydrocarbons (overburden).

Other more complex configurations can be used depending on the case. For example, if the essentially horizontal portion 4 of the electromagnetic heating well 2 passes through both underground formation areas 1 rich in hydrocarbons and underground formation areas 1 poor in hydrocarbons, it may be advantageous to arrange alternating segments of radiating coaxial line 106 (near the areas rich in hydrocarbons) and segments of coaxial transmission line 105 (near areas poor in hydrocarbons), still in order to limit needless losses of electromagnetic energy.

Figure 4:
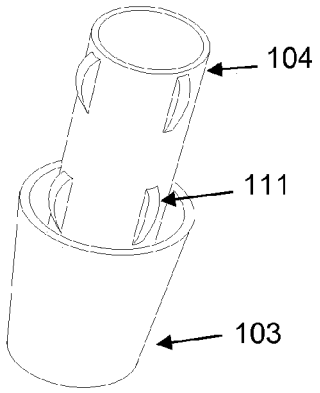
FIG. 4 shows a detail of an electromagnetic heating device used in the plant according to the invention.

The outer conductor 103 and the inner conductor 104 are separated by an insulating area. According to one advantageous embodiment (shown in FIG. 4), this insulating area is formed by sliding insulating elements 111 between the two conductors 103, 104, such as aluminum skis. This greatly facilitates operations for placing the plant according to the invention. Indeed, the outer conductor 103 can be placed first, then the inner conductor 104 can be slid inside the outer conductor 103, and kept at a constant distance therefrom. The sliding insulating elements 111 can be welded or glued directly to either of the conductors 103, 104.

The electrical power for the electromagnetic heating device 100 is provided by the generator 5 described above. According to the embodiment illustrated in FIG. 2, this involves a high-frequency generator 101 situated on the surface. This high-frequency generator 101 produces an electrical signal at a frequency between about 1 kHz and about 10 GHz. In general, the high-frequency generator 101 operates at a predetermined frequency, according to the international regulations in force. An impedance adaptation system 102 is provided at the output of the high-frequency generator 101 in order to prevent excessively significant reflections of the charge towards the generator. This embodiment is easy to implement because the presence of high-frequency generators on the surface is traditional and does not require a complex adaptation.

In this configuration, the two terminals of the generator are respectively connected to the outer conductor 103 and the inner conductor 104 of the coaxial transmission line 105. At the end of the radiating coaxial line 106, short-circuit elements 108 are provided (between the outer conductor 103 and the inner conductor 104) in order to complete the electric circuit.

Alternatively, it is possible to provide a re-entrant coaxial system as radiating coaxial line 106, which also makes it possible to complete the electric circuit. In such a system (not shown), the outer conductor 103 is connected, at the end of the radiating coaxial line 106, to a return conductor that is situated inside the inner conductor 104. One terminal of the generator is then connected to the outer conductor 103, and the other terminal to the return conductor.

In both cases, the architecture of the wells is easy to implement since it does not involve U-wells. The presence of a short-circuit at the end or the re-entrant configuration make it possible to prevent the end of the radiating coaxial line 106 from radiating like the rest of the radiating coaxial line 106 (i.e. like the length thereof). In this way, it is possible to avoid heating a part of the underground formation that does not have hydrocarbons, and the efficiency of the heating is thereby increased.

Moreover, these two architectures on one hand allow better adaptation between the generator and the radiating coaxial line, and on the other hand operation either by radiation, induction, or capacitive current induction depending on the choice of frequency. The latter is chosen according to the electrical properties of the reservoir.

Alternatively, according to the embodiment illustrated in FIG. 3, the generator 5 comprises two parts, i.e. a surface generator 109 and a high-frequency generator 110 situated in the electromagnetic heating well 2. The high-frequency generator 110 is powered by the surface generator 109, which supplies a unidirectional current, such as a direct current or a rectified current. Alternatively, it can involve a low-frequency alternating current, a rectifier system then being provided in the well. The current can be transmitted between the surface generator 109 and the high-frequency generator 110 by a bifilar or three-phase cabling or, advantageously, using the coaxial transmission line 105 described above, as shown in FIG. 3.

The high-frequency generator 110 is adapted to produce an electrical signal at a frequency between about 1 kHz and about 10 GHz. Advantageously, this high-frequency generator 110 comprises a vacuum tube and is in particular of the triode type. French application no. FR 08/04694 filed on Aug. 26, 2008 by Total S.A. contains the complete description of a high-frequency generator positioned in a well, and those skilled in the art may refer to it.

The embodiment of FIG. 3 has the advantage of doing away with the regulatory surface frequency limitations. In this way, it is possible to adapt the frequency of the electromagnetic emission to the characteristics of the underground formation 1, and also to vary the frequency of that emission during exploitation, the characteristics of the underground formation 1 being able to evolve. At the end of the electromagnetic heating device 100 (situated at the end of the electromagnetic heating well 2 that is arranged in the underground formation 1), short-circuit elements 108 are provided so as to complete the electric circuit. Alternatively, a reentrant coaxial system can be provided.

According to one particular embodiment, the electromagnetic heating well 2 also includes hydrocarbon tapping means and/or means for injecting water or steam into the underground formation 1. In this case, the circulation of the hydrocarbons, water, or steam is preferably done in the central part of the electromagnetic heating device 100, i.e. inside the inner conductor 104. The means for injecting water or steam can also be replaced by means for injecting any other type of auxiliary fluid, for example aqueous solution or supercritical fluid (in particular $CO_2$).

The outer conductor 103 and the inner conductor 104 can have a metallurgy identical to the casings and casing pipes used in traditional production wells. The outer conductor 103 preferably has mechanical characteristics that ensure the resistance of the electromechanical heating device 100.

At the radiating coaxial line 106, the outer conductor 103 partially interrupted by the insulating windows 107 can be surrounded by a protective layer, transparent to the high-frequency radiation and stable at a high temperature. This protective layer can for example be formed from cement or mortar, or calibrated gravel (which can serve as a filter at the inlet in case of hydrocarbon tapping in the electromagnetic heating well 2) or metal liner. The use of a protective layer made from a composite material with little resistance to high temperatures is thus avoided.

Alternatively, for the radiating coaxial line 106, it is possible to do away with any protective layer around the outer conductor 103, in which case the outer conductor 103 is directly in contact with the underground formation 1 ("open hole" configuration). According to one advantageous embodiment, the electromagnetic heating device 100 is able to move in the electromagnetic heating well 2, for example owing to a sliding assembly (using sliding guides made from aluminum or other materials). In this way, it is possible to perform translational movements of the electromagnetic heating device 100 along the axis of the well 2.

By making the electromagnetic heating device 100 perform slow alternating movements, a more even electromagnetic emission that is also more extended in the underground formation 1 is ensured, and the mobilization of the oils is thus increased. Such movements make it possible to obtain a temperature landscape adapted to the recovery.

Method for Extracting Hydrocarbons

The inventive method makes it possible to extract hydrocarbons contained in the underground formation 1. "Hydrocarbons" refers to the chemical compounds containing only carbon and hydrogen atoms.

The extracted hydrocarbons can be liquid or gas. They can preexist in the underground formation before being tapped, or can be obtained by:

- upgrading from heavier hydrocarbons present in the underground formation;
- conversion from organic matter (in particular coal or bituminous shale) present in the underground formation.

If applicable, the upgrading and/or conversion are obtained in situ at least partially by the heating of the underground formation according to the invention.

"Upgrading" refers to any method known in the oil/gas field for modifying the quality of the hydrocarbons (in particular oils) and in particular to make the hydrocarbons more recoverable. The term "upgrading" covers in particular any chemical transformation method making it possible to obtain hydrocarbons that are lighter than the hydrocarbons initially present in the underground formation. Upgrading in particular makes it possible to facilitate the production of hydrocarbons in the reservoir, or to facilitate the transport of surface hydrocarbons.

"Conversion" refers to any method for transforming organic matter into hydrocarbons, in particular the pyrolysis of bituminous shales into hydrocarbons. "Organic matter" refers to materials comprising substances having an essentially carbon-based structure, and including hydrocarbonated compounds and their derivatives.

The extraction method according to the invention comprises electromagnetic heating of the underground formation 1 using the electromagnetic heating device(s) 100; and the tapping of the hydrocarbons in the underground formation 1 and their transport to the surface. The tapping of the hydrocarbons is preferably done primarily in the production wells 6, and/or possibly in the electromagnetic heating wells 2. The electromagnetic heating is done by electromagnetic emission at the radiating coaxial line. The electromagnetic emission is primarily expressed in the form of radiation at the highest frequencies (in the vicinity of from about 500 kHz to about 10 GHz) or primarily in the form of induction at the lowest frequencies (in the vicinity of about 1 kHz to about 500 kHz).

The choice of heating by induction or radiation depends mainly on the nature of the underground formation 1. If the underground formation 1 has a high electrical conductivity (for example due to the presence of highly conductive clays), it is preferable to use induction. On the other hand if the underground formation 1 has a low electrical conductivity, it is preferable to use radiation.

The heating of the underground formation 1 can be done only through the direct transmission of electromagnetic energy to the underground formation 1 and to the materials that make it up. But it can also be completed by an injection of steam (traditionally), preferably via the electromagnetic heating wells 2 themselves; or by an injection of water, preferably via the electromagnetic heating wells 2 themselves, the water being vaporized in situ owing to the electromagnetic heating.

It is also possible to use, in place of the water or vapor, any other auxiliary fluid (as described above), which is heated and possibly vaporized in situ. The auxiliary fluid in liquid form dispersed in the formation is in particular capable of picking up the electromagnetic radiation emitted by the electromagnetic heating device 100. The vapor produced is dispersed in the formation 1, it infiltrates the rock, then, cooling (in particular by transferring heat to the hydrocarbons of the formation), becomes liquid again. In this way, the auxiliary fluid makes it possible to increase the efficiency of the heating of the formation 1.

The invention makes it possible to reach a temperature of more than 200° C. in the underground formation 1, preferably more than 300° C., more particularly preferably more than 350°, and for example about 400° C. The (preferred) absence of fragile composite material at the various wells makes such temperatures bearable for the plant and advantageous in terms of exploitation of the underground formation.

The invention claimed is:

1. A plant for extracting hydrocarbons contained in an underground formation, comprising:

a hydrocarbon tapper;

at least one generator; and at least one electromagnetic heating well in the underground formation, comprising an electromagnetic heating device connected to the generator;

wherein the electromagnetic heating device comprises a radiating coaxial line and the electromagnetic heating well has one end in the underground formation, the electromagnetic heating device being short-circuited or re-entrant at the end.

2. The plant according to claim 1, comprising at least one production well, in the underground formation, the production well comprising at least part of the hydrocarbon tapper.

3. The plant according to claim 2, wherein:

the electromagnetic heating well comprises a substantially vertical portion and a substantially horizontal portion;

the production well comprises a substantially vertical portion and a substantially horizontal portion;

the substantially horizontal portion of the electromagnetic heating well being arranged above the substantially horizontal portion of the production well; and the substantially horizontal portion of the electromagnetic heating well forming, with the substantially horizontal portion of the production well, in the horizontal plane, an angle between 60 and 120°.

4. The plant according to claim 3, wherein:

the substantially horizontal portion of the electromagnetic heating well forming, with the substantially horizontal portion of the production well, in the horizontal plane, an angle between 70 and 110°.

5. The plant according to claim 1, wherein the electromagnetic heating device comprises a coaxial transmission line.

6. The plant according to claim 5, wherein the electromagnetic heating well comprises a substantially vertical portion and a substantially horizontal portion, at least part of the coaxial transmission line being arranged in the substantially vertical portion, and at least part of the radiating coaxial line being arranged in the substantially horizontal portion.

7. The plant according to claim 1, wherein the electromagnetic heating device comprises an outer conductor, an inner conductor, and insulating elements sliding between the outer conductor and the inner conductor.

8. The plant according to claim 1, wherein the electromagnetic heating well also comprises at least part of the hydrocarbon tapper.

9. The plant according to claim 1, wherein the electromagnetic heating well comprises a water or steam injector in the underground formation.

10. The plant according to claim 1, wherein the generator comprises a high-frequency generator arranged in the electromagnetic heating well.

11. The plant according to claim 1, wherein the electromagnetic heating device is able to move in the electromagnetic heating well.

12. The plant according to claim 1, wherein the radiating coaxial line comprises an inner conductor and an outer conductor interrupted by a plurality of insulating windows.

13. A method for extracting hydrocarbons in an underground formation, comprising:

(a) electromagnetic heating of the underground formation using at least one electromagnetic heating device positioned in the underground formation, and comprising a radiating coaxial line; and (b) tapping the hydrocarbons in the underground formation and transporting the hydrocarbons towards the surface;

(c) wherein the method is implemented in a plant comprising:

at least one generator;

at least one electromagnetic heating well in the underground formation, the at least one electromagnetic heating device being connected to the generator;

wherein the at least one electromagnetic heating device comprises a radiating coaxial line and the electromagnetic heating well has one end in the underground formation, the at least one electromagnetic heating device being short-circuited or re-entrant at the end.

14. The method according to claim 13, wherein the electromagnetic heating of the underground formation is done by induction and/or by radiation.

15. The method according to claim 13, also comprising one of:

heating the underground formation by injecting steam into the underground formation; or producing steam in the underground formation by injecting water and electromagnetically heating the water, and heating the underground formation via the steam produced.

* * * * *